US006839941B2

(12) United States Patent
Locatelli et al.

(10) Patent No.: US 6,839,941 B2
(45) Date of Patent: Jan. 11, 2005

(54) CARDING MACHINE AND CARDING METHOD

(75) Inventors: Claudio Locatelli, Palazzolo Sull'Oglio (IT); Silvano Patelli, Palazzolo Sull'Oglio (IT)

(73) Assignee: Marzoli S.p.A., Palazzolo Sull'Oglio (IT)

( * ) Notice: Subject to any disclaimer, the term of this patent is extended or adjusted under 35 U.S.C. 154(b) by 0 days.

(21) Appl. No.: 10/608,186

(22) Filed: Jun. 30, 2003

(65) Prior Publication Data

US 2004/0000035 A1 Jan. 1, 2004

(51) Int. Cl.[7] ..... D01G 15/00
(52) U.S. Cl. ..... 19/98; 19/105
(58) Field of Search ..... 19/64.5, 65 A, 19/98, 99, 100, 101, 105, 200, 201, 202, 203, 204, 205, 107, 108, 110, 102, 109, 111, 113

(56) References Cited

U.S. PATENT DOCUMENTS

| | | | | | |
|---|---|---|---|---|---|
| 878,884 | A | * | 2/1908 | Kip et al. | 19/102 |
| 2,908,046 | A | * | 10/1959 | Ohnishi | 19/99 |
| 5,022,121 | A | * | 6/1991 | Rutz | 19/102 |
| 5,448,800 | A | * | 9/1995 | Faas et al. | 19/108 |
| 6,061,878 | A | * | 5/2000 | Patelli et al. | 19/105 |
| 6,065,190 | A | * | 5/2000 | Mandl et al. | 19/107 |
| 6,477,742 | B2 | * | 11/2002 | Pferdmenges et al. | 19/109 |
| 6,571,428 | B2 | * | 6/2003 | Patelli et al. | 19/105 |

FOREIGN PATENT DOCUMENTS

| | | |
|---|---|---|
| DE | 18 0 10 968 A | 11/1968 |
| EP | 0 608 686 A1 | 1/1996 |
| EP | 0 927 779 A1 | 7/1999 |
| EP | 1 207 223 A1 | 5/2002 |
| WO | WO 98 14649 | 4/1998 |

OTHER PUBLICATIONS

European Search Report.

* cited by examiner

*Primary Examiner*—Gary L. Welch
(74) *Attorney, Agent, or Firm*—Hogan & Hartson LLP

(57) ABSTRACT

A carding machine comprises a main drum fed by a feed system with roughly attenuated and cleaned fibers, a plurality of fixed clothed segments, and opening cylinders or briseurs which feed the said main drum at different points of the main drum.

The machine is characterized in that it comprises a first set of moving flats which performs a first, gentle parallelization and a second set of moving flats which carries out another parallelization that is more aggressive than the first.

23 Claims, 6 Drawing Sheets

CARDING MACHINE AND CARDING METHOD

FIELD OF THE INVENTION

The present invention relates to a carding machine in which fibrous material is worked into a belt of untwisted fibres in the form of a web that will be condensed and passed on to subsequent processing stages.

BACKGROUND OF THE INVENTION

The purpose of the carding operation is to turn raw material consisting of tufts of fibres, which have already undergone certain initial cleaning and opening processes, into a belt of untwisted fibres in the form of a web that is, as far as possible, free of impurities and non-homogeneities such as residual dirt from the previous processes, waste and tangles or "neps".

As is known, in general terms, a carding machine comprises a main carding drum supplied by opening cylinders, generally termed "briseur", while around it are a plurality of systems (a system of flats and auxiliary cleaning mechanisms and the like) which interact with the main drum in order to open, clean and attenuate the fibres.

To improve the efficiency of the interaction between the systems surrounding it and the main drum and obtain a fibre belt that has ever less twist and is of increasingly high impurity, and hence of better quality, modern types of carding machines use a multiple feed to the main drum.

One example of the above is disclosed, for example, in European Patent No. 927 779 in the name of the present Applicant.

The multiple feed to the main drum provides ideal conditions for the systems interacting with the main drum to operate effectively on the fibres.

However, it has also been observed that the opportunity to make the best use of the thin layer of fibres presented to the main drum by the multiple-feed system, and so obtain a fibre belt with a high degree of parallelization and cleanliness, is inherently limited by problems with the reliability of the systems themselves.

In other words, even though the systems interacting with the main drum are presented with a thin layer of fibre with good processing properties, nonetheless to achieve a high degree of parallelization and cleanliness of the fibre would still require the use of systems so advanced in their engineering properties as to make frequent maintenance necessary.

There is therefore a need to provide carding machines capable of improving the quality of the belt of fibres put out, while maintaining excellent characteristics of reliability and requiring little maintenance.

SUMMARY OF THE INVENTION

The problem addressed by the present invention is that of devising a carding machine whose structural and functional characteristics are such as to satisfy the above requirements and at the same time overcome the problems discussed with reference to the prior art.

This problem is solved with a carding machine in accordance with the claimed apparatus. In addition, this problem is solved by a carding method in accordance with the claimed method.

Other characteristics and the advantages of the carding machine and carding method according to the present invention will be found in the description given below of a preferred example of an embodiment thereof, provided by way of non-restrictive indication, with reference to the accompanying figures.

DESCRIPTION OF THE PREFERRED EMBODIMENTS

Figure 1:
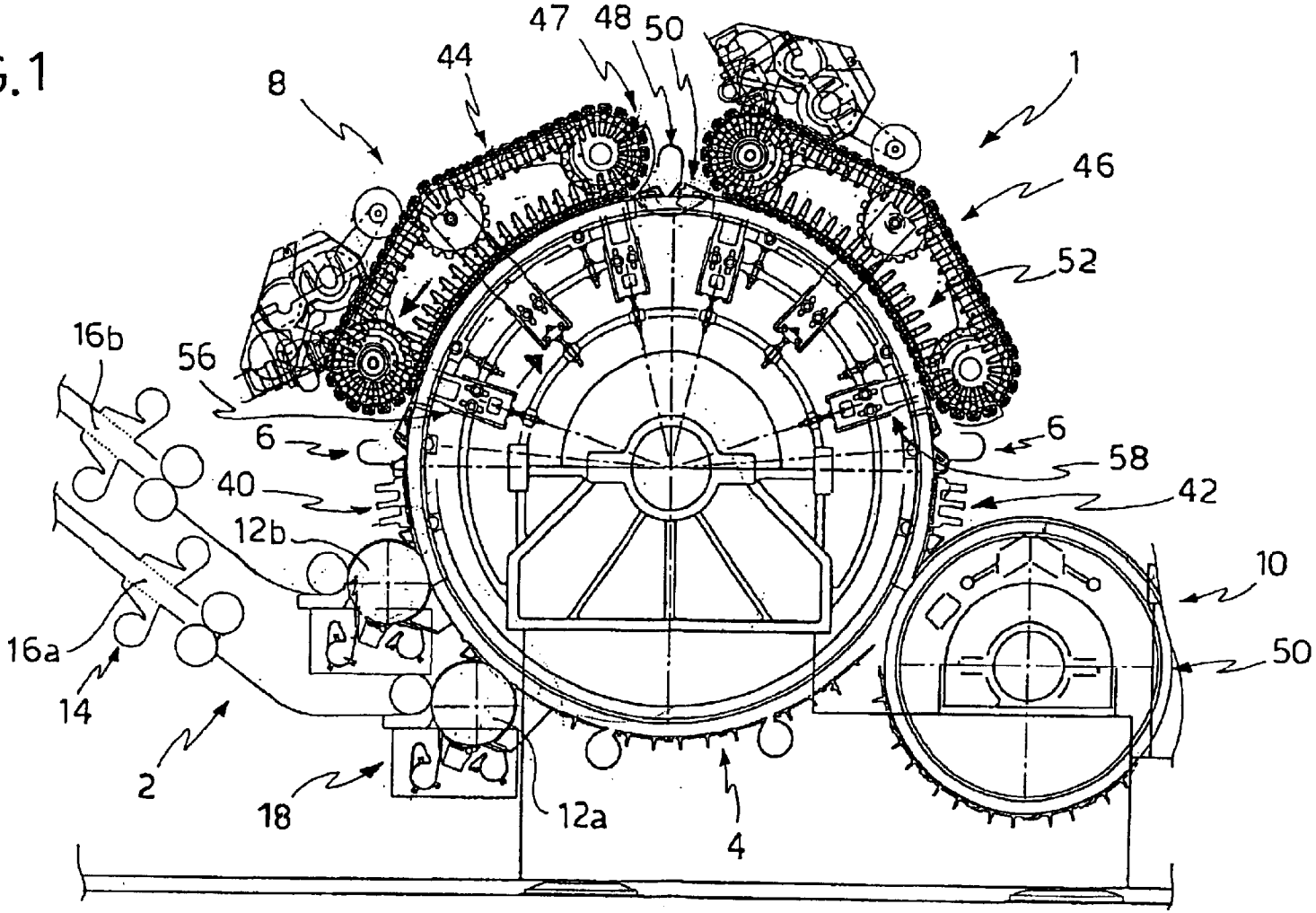
FIG. 1 is a schematic view of a carding machine in one embodiment, comprising a main drum, a feed system, systems of flats, auxiliary mechanisms and a doffer system.

With reference to FIG. 1, reference number 1 indicates a carding machine as a whole comprising a feed system 2, a main drum 4, auxiliary mechanisms 6, systems of flats 8 and doffer systems 10.

The feed system 2 comprises a plurality of opening cylinders or "briseur". The description which follows refers, by way of example, to a feed system provided with a first briseur 12*a* and a second briseur 12*b*.

Each briseur has an external clothing around its lateral surface. This clothing is preferably of the saw-tooth type and these teeth project in the direction of rotation of the briseur.

Upstream of the briseurs is a storage apparatus 14 that comprises, for example, a first container 16*a* upstream of the first briseur 12*a* and a second container 16*b* upstream of the second briseur 12*b*, thus giving separate feed lines leading to the main drum.

The constructional and functional details of the above-mentioned feed lines to the main drum 4 are disclosed in European Patent No. 927 779 in the name of the present Applicant, the teaching of which is explicitly incorporated herein.

In another alternative embodiment, there is, upstream of the briseurs, a single storage container supplying both simultaneously.

The feed system 2 preferably also includes at least one fibre cleaning and attenuating system 18 accompanying each briseur. The said system comprises, by way of example, clothed segments with flow deflector, blades and suction nozzles.

The briseurs are turned at a high angular velocity so that the clothing with which they are covered is able to pick up, by means of the teeth with which it is provided, the raw fibrous material supplied by the feed system and carry it around.

While on the briseurs, the fibrous material is preferably subjected to a first cleaning and attenuating action by means of the fibre cleaning and attenuating system 18.

The briseurs interact with the main drum 4 by feeding the fibre to it at different points of its circumference.

In another embodiment of the carding machine, the points of interaction between the briseurs and the main drum are far enough apart around the circumference of the main drum to allow the insertion, in the peripheral region of said main drum lying between the points of interaction, of auxiliary pretreatment mechanisms comprising, in one embodiment, blades, clothed segments, suction nozzles and fixed sets of flats. On this subject, refer to document EP 1,207,223 in the name of the present Applicant, the teaching of which is explicitly incorporated herein.

The main drum 4 is provided around its lateral surface with a clothing having teeth that project preferably in the direction of rotation of the main drum.

The main drum is turned at a lower angular velocity than the briseurs. However, because the said main drum has a much greater diameter than the briseurs, the peripheral speed of the said main drum is much greater than that of the briseurs.

In the light of the above it will be realized that, although said main drum is rotating in the same direction, at the point of contact, as the briseurs and although it has clothing with teeth projecting in the direction of rotation, an at least partial transfer of the fibre occurs from the said briseurs to the main drum at the points of interaction between the briseurs and the main drum.

What happens is that the teeth of the clothing of the main drum move closer and closer to the teeth of the clothing of the briseur, collecting and carrying away much of the fibre from the briseur and carrying it around on the main drum in the form of a thinner layer of fibre than the layer of material that was fed to the briseurs.

While it is on the surface of the main drum 4, the thin layer of fibrous material undergoes the action of the auxiliary mechanisms 6 and of the flat systems 8 surrounding the said drum.

The auxiliary mechanisms preferably include blades, fixed clothed segments and suction nozzles. The said mechanisms work on the thin layer of fibre carried around by the main drum to effect a further opening of the fibre in addition to a further cleaning and attenuation.

In a preferred embodiment of the carding machine according to the invention, the flat systems include at least one fixed clothed segment, preferably a first fixed clothed segment 40 and a second fixed clothed segment 42, and at least two sets of moving flats arranged downstream of the said briseurs.

The said flat systems preferably comprise a first set of moving flats 44 and, downstream of the said first set of moving flats 44, a second set of moving flats 46.

In a preferred arrangement, the first fixed clothed segment 40 is arranged downstream of the second briseur 12*b* and upstream of the first set of moving flats 44, while the second fixed clothed segment 42 is arranged downstream of the second set of moving flats 46.

In the above arrangement, the first fixed clothed segment 40, preferably together with the suction nozzles and clothed segments of the auxiliary mechanisms, represents a precarding region situated upstream of the first set of moving flats 44, while the second fixed clothed segment 42, preferably together with additional suction nozzles or blades, represents a precarding region situated downstream of the second set of moving flats 46.

Between the first set of moving flats and the second set of moving flats there is preferably a refining region 47 which, in the embodiment described of the carding machine 1, advantageously has suction nozzles 48 and at least one control plate 50.

The sets of moving flats possess a plurality of flats comprising a bar 52 whose length is equal to the length of the generatrix of the main drum and whose width is much less than the circumferential development of the entire set of moving flats. The said width of the bar preferably does not exceed a few centimetres.

That part of each bar which is towards the lateral surface of the main drum 4 is provided with a covering comprising a plurality of teeth pointing in the direction of travel of the said bar.

The structure, functions and efficiency of operation of this covering is characterized not only by numerous constructional parameters which define the geometry of the teeth, but also by the density of these teeth.

In particular, the term "population" is often used in the industry to denote the density of the teeth of the bar covering, that is the number of teeth per unit surface area, for example per square inch or square centimetre.

The first set of moving flats preferably has a population of teeth on its bars different from the population of teeth on the second set of moving flats. In particular, in a preferred embodiment, the population of teeth on the first set of moving flats is less than the population of teeth on the second set of moving flats.

In an illustrative embodiment of the carding machine according to the invention, the population of teeth on the first set of moving flats 44 is between 200 and 500 points/in$^2$ (between 30 and 75 points/cm$^2$), preferably equal to 400 points/in$^2$ (60 points/cm$^2$), while the population of teeth on the second set of moving flats 46 is between 400 and 1000 points/in$^2$ (between 60 and 160 points/cm$^2$), preferably between 700 and 800 points/in$^2$ (between 100 and 130 points/cm$^2$).

In another embodiment, the constructional parameters of the teeth of the first set of moving flats give the said teeth a different working strength than the teeth of the second set of moving flats. The working strength of the teeth of the first set of moving flats is preferably less than that of the teeth of the second set of moving flats.

In another embodiment of the carding machine, the work performed by the first set of moving flats is made less aggressive than the work performed by the second set of moving flats by appropriately adjusting the speed of travel of the flats, the radial registration between the main drum and the sets of moving flats, the carding angles of the said sets of flats, the angles of the teeth, etc.

The carding machine 1 preferably also has registration means for registering the radial position of the sets of moving flats relative to the main drum. In an alternative embodiment, the said carding machine 1 comprises first registration means 56 that act on the first set of moving flats 44, and second registration means 58 that act on the second set of moving flats 46.

With the machine in normal carding operation, the sets of moving flats set up a travelling motion of their bars which is substantially responsible for the effect of these sets of flats on the fibre.

This travelling movement takes place at a slower speed of travel than the peripheral speed of the main drum and is either against or with the direction of rotation of the main drum.

In another embodiment, the direction of travel of the bars of the first set of moving flats is in the opposite direction to the travel of the bars of the second set of moving flats. As an example, the travelling movement of the first set of moving flats is in the opposite direction, in the area of interaction, to the rotation of the main drum, while the travel of the second set of moving flats is in the same direction, in the area of interaction, as the rotation of the said main drum.

As a preference, the speed of travel of the first set of moving flats is between 80 and 300 millimetres/minute, while the speed of travel of the second set of moving flats is between 100 and 500 millimetres/minute.

The bars of the set of moving flats are positioned around the main drum in such a way that they have a tolerance of positioning of the order of one tenth.

During normal operation of the carding machine, the thin layer of material supplied by the briseurs to the main drum is carried around by the main drum on the toothed clothing in which the said main drum is wrapped.

The auxiliary mechanisms that surround the said main drum work the fibre on it, increasing its degree of cleanliness and attenuation, and complete its preparation for subsequent working by the sets of moving flats.

The interaction of the thin layer of fibre with the first set of moving flats works the fibre in such a way as to perform upon it, not only a cleaning action and an action of removal of neps or tangles, but also a first parallelization, by the action of the covering of the bars of this set of flats.

The teeth of the covering of the set of moving flats brush the teeth of the clothing of the main drum so that the fibre spread out on the main drum is straightened in a direction approximately tangential to the main drum, that is it is made parallel. In other words, the teeth of the covering of the bars brush the fibres and comb them out.

Advantageously, the covering of the bars of the first set of moving flats has a tooth population less than that of the second set of moving flats.

The fibre now undergoes a first moderate parallelization whereby the fibres are straightened without damaging them, that is avoiding tears and breakages.

The fibres leaving the first set of flats optionally undergo a further cleaning and attenuating action in the refining region 47 between the first set of moving flats and the second set of moving flats, before interacting with-the second set of moving flats.

Here the fibre is subjected not only to another cleaning action and nep-removing action but also to a second parallelization, more thorough and efficient than the first, making good use of the preparation for this action given to it initially by the multiple opening of the briseurs and also by the first parallelization, always without producing tears and breakages.

In other words, the multiple feeding of the main drum makes available a fibre that can be worked highly satisfactorily due to its characteristics of partial opening and cleanliness and to the fact that it is in a thin enough layer for a very thorough, aggressive carding action to be applied to it.

Owing to the partial straightening of the fibres in the first set of moving flats, the second set of moving flats can perform a very thorough parallelization without prejudice to the integrity of the fibre or to the general working conditions, as the fibre flows continuously and without severe straightening underneath the second set of flats.

On leaving the region of interaction with the sets of moving flats, the fibre is conveyed to the doffer system 10 to be lifted off the main drum 4, optionally after having been further cleaned in the post-carding region.

The doffer system 10 comprises at least one doffer roller 50. The said doffer roller is again surface-covered with a clothing, preferably having sawteeth, by which it picks up the twistless fibres cleaned by the main drum, downstream of the systems of flats.

The fibres are preferably taken from the doffer roller by a web-detaching unit and are condensed into a very thin web. The web then goes through a funnel which turns it into a slither.

Figure 2:
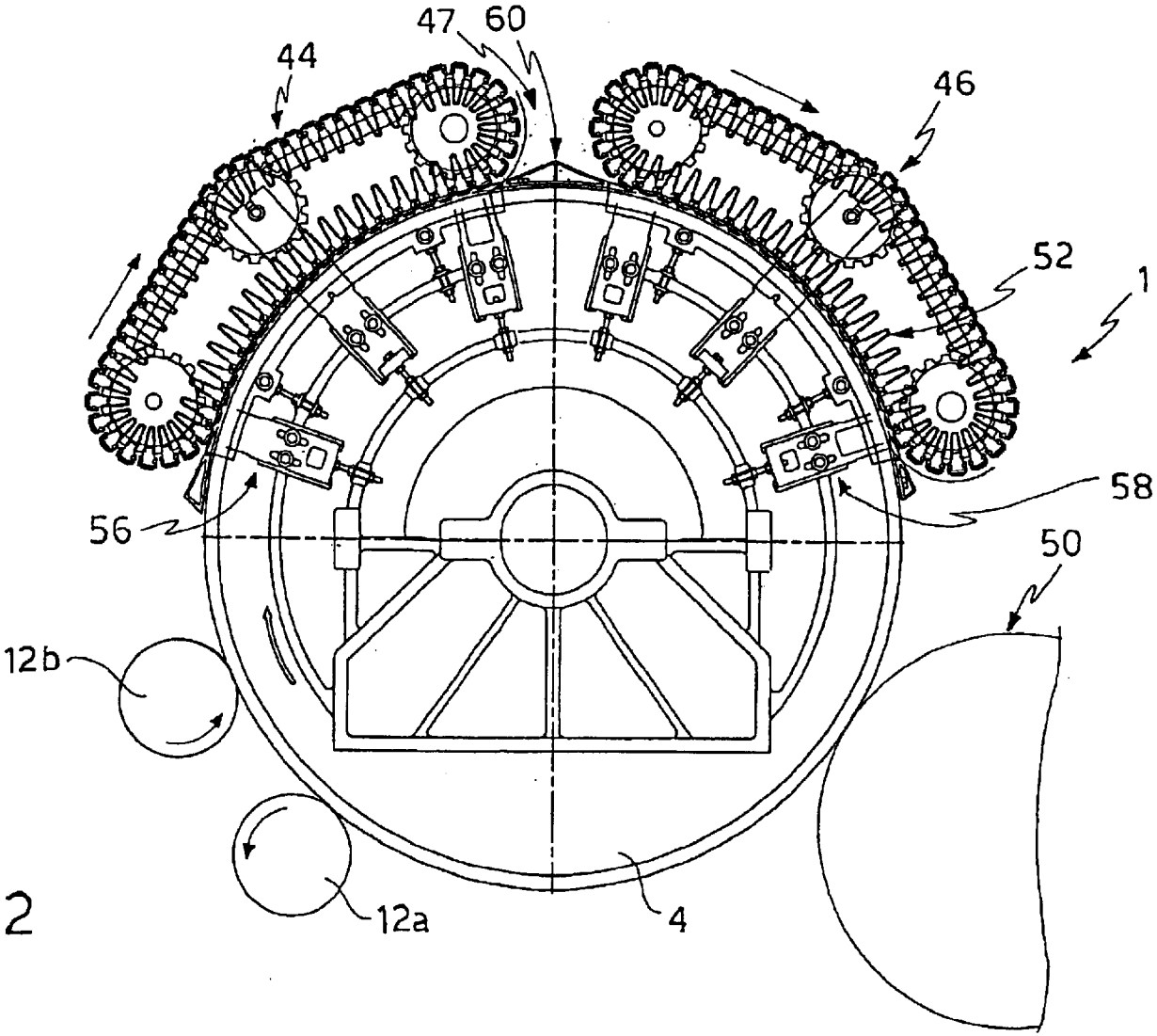
FIGS. 2 to 6 show a schematic view of a carding machine in other alternative embodiments.
Figure 3:
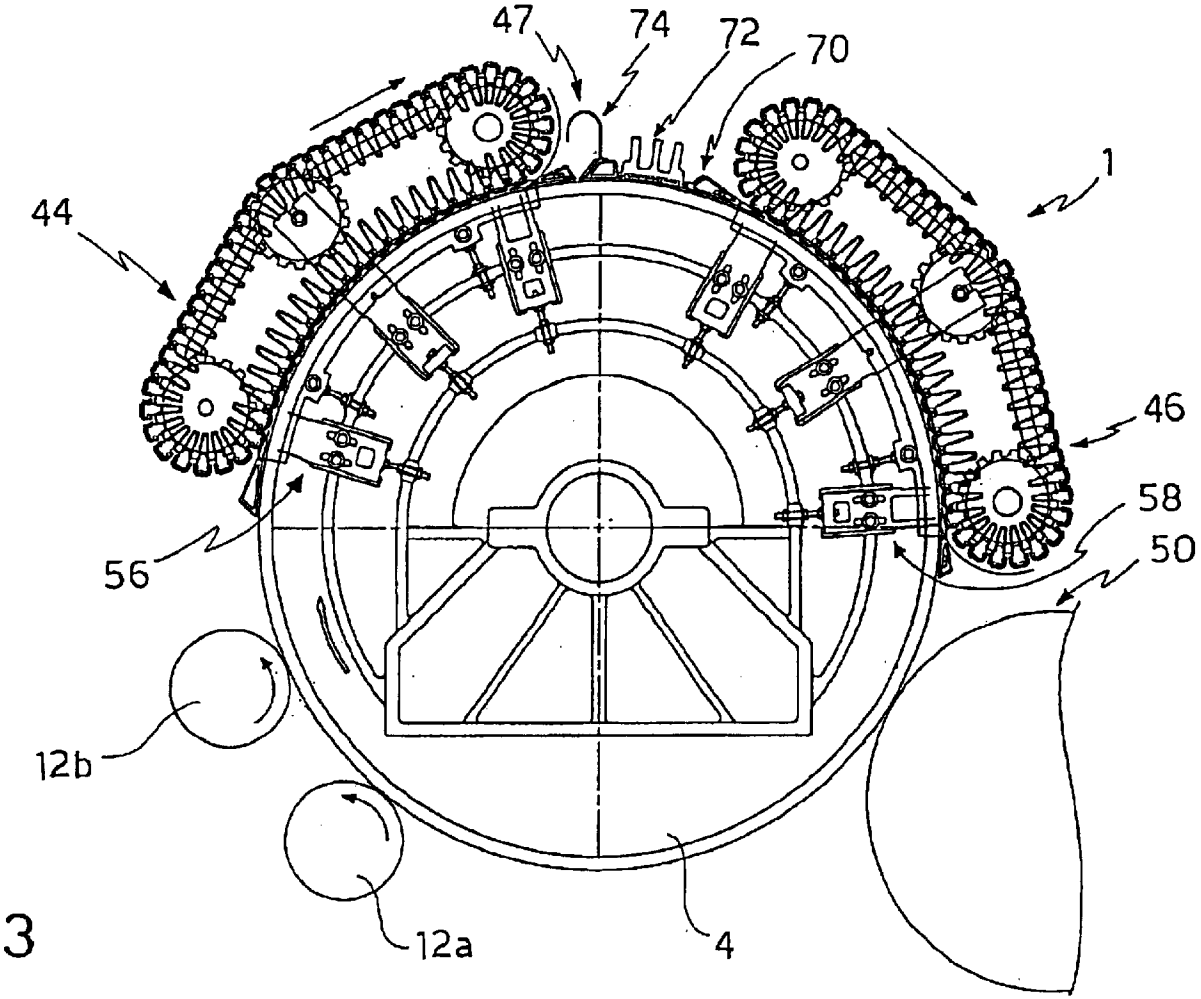
Figure 4:
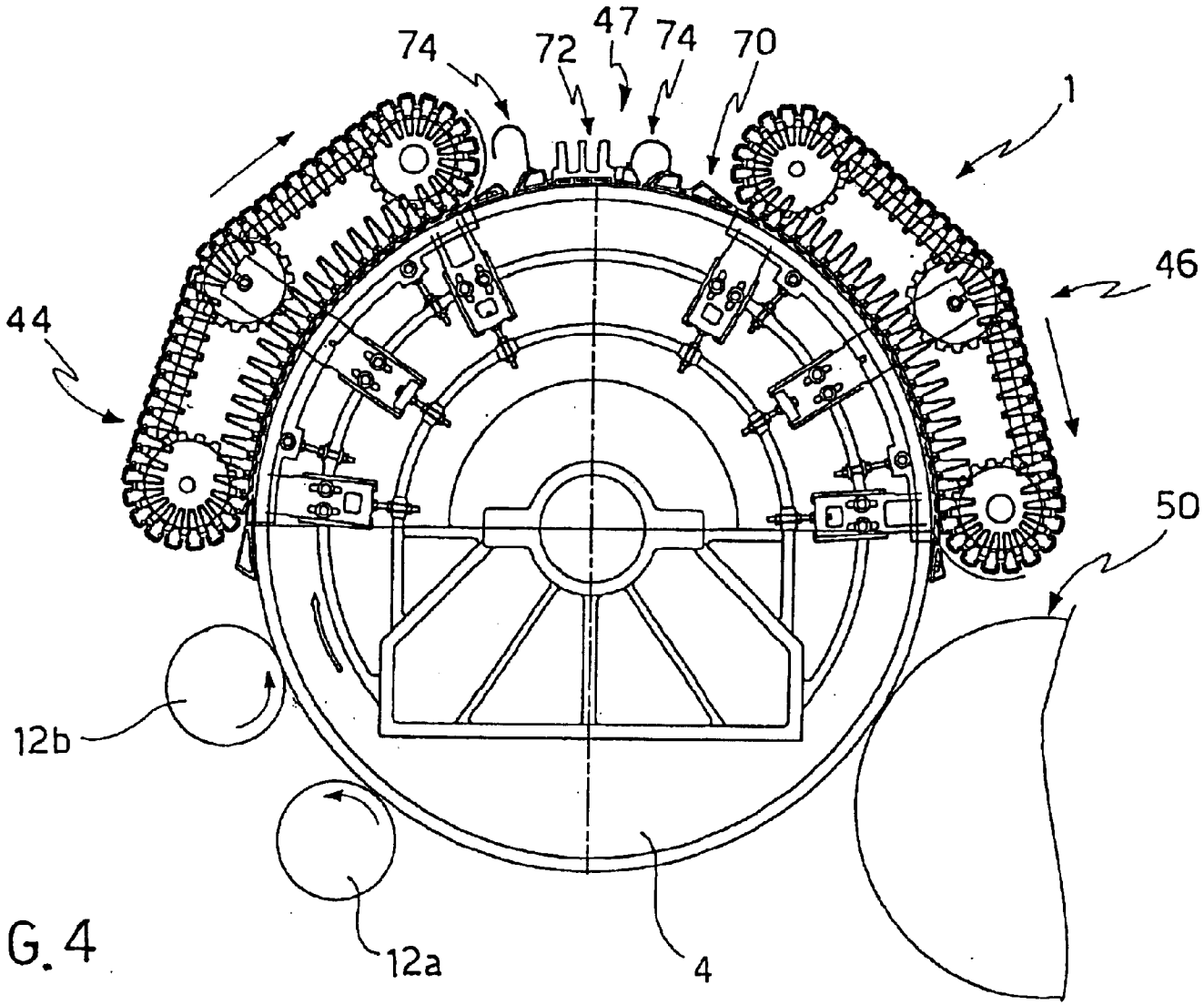
Figure 5:
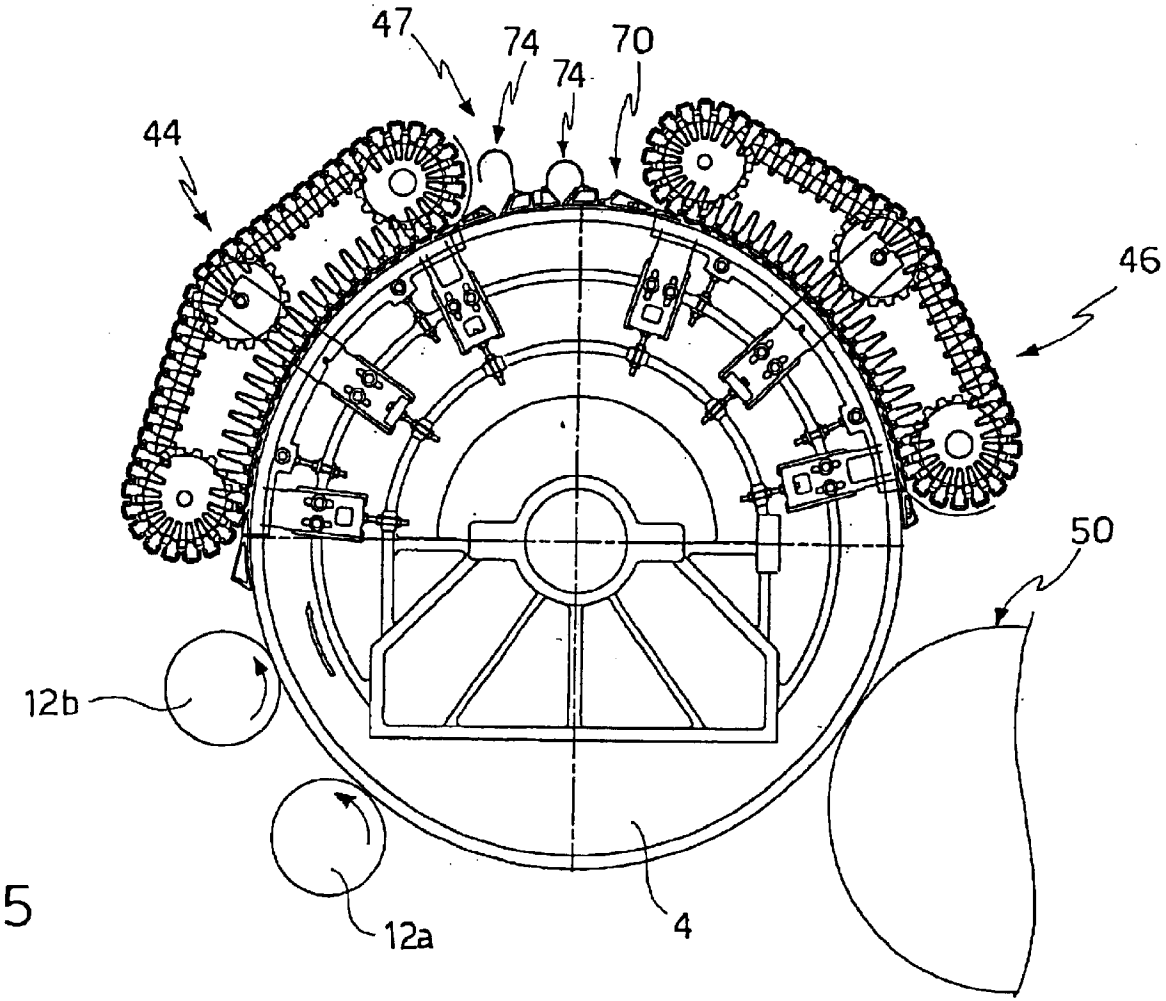
Figure 6:
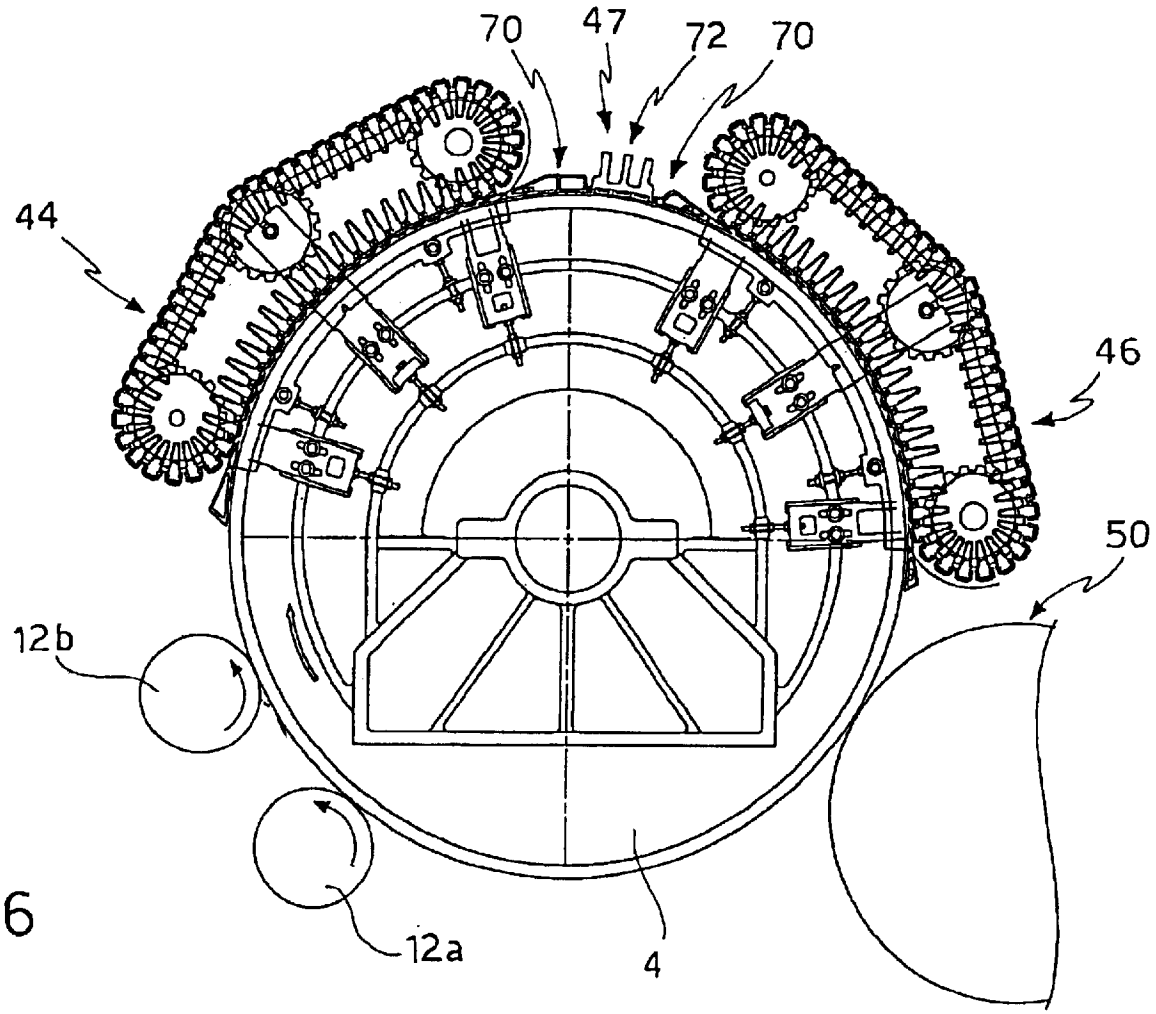

In other alternative embodiments of the carding machine 1, the refining region 47 between the first set of moving flats 44 and the second set of moving flats 46 is provided with at least one control plate 60 which preferably forms a cover between the first set of moving flats and the second set of moving flats (FIG. 2).

In other alternative embodiments, the refining region 47 has a series of control plates 70, fixed clothed segments 72 and suction nozzles with corresponding blade 74, variously combined with each other (FIGS. 3, 4, 5 and 6).

Advantageously, the provision of a refining region downstream of the first set of moving flats 44 and upstream of the second set of moving flats 46 makes the work of the second set of moving flats more effective.

In particular, the refining region 47 is advantageously provided with control plates 60 for working synthetic fibres in particular. The said refining region also has suction nozzles with associated blades and fixed clothed segments advantageously for working very closed materials or in relation to the degree of cleanliness of these materials.

In addition, other embodiments of the carding machine employ, between the points of interaction of the briseurs with the main drum, a combination of suction nozzles with corresponding blades, control plates, and fixed clothed segments. Advantageously, the said combinations make it possible to work the fibre supplied by an upstream briseur before the fibre is joined to the fibre fed in by a downstream briseur, in order, for example, to begin to even out the layer of two raw fibres which differ in terms of type, degree of cleanliness, opening and the like.

The details of construction and function of these embodiments are disclosed in document EP 1,207,223 in the name of the present Applicant, the teaching of which is incorporated herein.

In another embodiment, the said carding machine comprises cleaning devices which cooperate with the said sets of moving flats in order to clean the said flats of snagged fibres, dirt and the like.

Unusually, the carding machine according to the invention enhances the quality of the belt of fibre produced yet maintains excellent reliability and low maintenance requirements.

Specifically, the multiple fibre feed system presents a fibre that has excellent working characteristics capable of producing a sliver with a very high degree of parallelization.

The system equipped with at least two sets of moving flats enables one of these to be used with an extremely high population of teeth but without the teeth acting aggressively on the fibre and introducing small lacerations in it.

At the same time, despite using a very high population of teeth, the synergy of the multiple opening and the multiple action of the sets of moving flats (which are preferably differentiated from each other) prevents any fierce braking action by the teeth on the fibres carried by the main drum. This is because the high population of teeth would produce a sort of "dam effect" on the fibres if the fibres were not already appropriately prepared for this thorough working.

The fluidity with which the fibres opened by the briseurs are worked, first gently by a first set of moving flats and then more thoroughly by a second set of moving flats, gives the machine extremely low maintenance requirements and enables these systems to be run comfortably within their capacity.

In another advantageous aspect, the carding machine further enhances the capacity of the second set of moving flats by enabling the fibre carried by the main drum to be put through further refining processes before it goes through the second parallelization.

In an advantageous aspect, the refining includes steps of cleaning and straightening which increase the fibre's readiness to undergo very thorough parallelization.

Clearly, a person skilled in the art will be able to make numerous modifications and alterations to the carding machine described above in order to satisfy particular local requirements, all such modifications and alterations however lying within the scope of protection of the invention as defined by the following claims.

What is claimed is:

1. A carding machine comprising a main drum fed by a feed system with roughly attenuated and cleaned fibers; at least one system of flats for carding the fibers, the at least one system of flats acting on the main drum wherein the feed systems comprises at least two briseurs which feed the main drum at different points of the main drum, and wherein the system of flats comprises a plurality of sets of moving flats arranged downstream of the briseurs, wherein each of the sets of moving flats is capable of moving both against and with a direction of rotation of the main drum.

2. The carding machine according to claim 1, in which the system of flats comprises a first set of moving flats and a second set of moving flats arranged downstream of the first set of moving flats, wherein a direction of travel of the bars of the first set of moving flats is in the opposite direction of travel of the bars of the second set of moving flats.

3. The carding machine according to claim 2, in which the sets of moving flats have a covering provided with a plurality of teeth having a predetermined population.

4. A carding machine comprising:

a main drum fed by a feed system with roughly attenuated and cleaned fibers, wherein the feed system comprises at least two briseurs which feed the main drum at different points of the main drum; and at least one system of flats for carding the fibres, acting on the main drum, wherein the system of flats comprises a first set of moving flats and a second set of moving flats arranged downstream of the first set of moving flats and wherein each set of moving flats has a covering provided with a plurality of teeth having a predetermined population, the population of teeth on the first set of moving flats being less than the population of teeth on the second set of moving flats.

5. The carding machine according to claim 4, wherein there is between the sets of moving flats a refining region directed towards the main drum and capable of working the fibre carried by the main drum.

6. The carding machine according to claim 5, wherein the refining region comprising suction nozzles.

7. The carding machine according to claim 6, wherein the suction nozzles have corresponding blades.

8. The carding machine according to claim 7, wherein the refining region comprises control plates.

9. The carding machine according to claim 8, wherein the refining region comprises at least one fixed clothed segment.

10. The carding machine according to claim 4, further comprising a precarding region directed towards the main drum and situated upstream of the first set of moving flats.

11. The carding machine according to claim 10, in which the precarding region comprises at least one fixed clothed segment, suction nozzles and blades.

12. The carding machine according to claim 4, further comprising a post-carding region directed towards the main drum and situated downstream of the second set of moving flats.

13. The carding machine according to claim 12, wherein the post-carding region comprises at least one fixed clothed segment, suction nozzles and blades.

14. The carding machine according to claim 4, further comprising, located upstream of the briseurs, a storage apparatus that produces separate feed lines for the briseurs towards the main drum.

15. The carding machine according claim 4, further comprising a fiber cleaning and attenuating system for each briseur.

16. The carding machine according to claim 4, wherein the points of interaction between the briseurs and the main drum are distant from each other on the circumference of the main drum, allowing the insertion of auxiliary mechanisms for pretreating the fibre fed to the first briseur located upstream of the second briseur.

17. The carding machine according to claim 16, wherein the auxiliary pretreatment mechanism comprises blades and suction nozzles.

18. The carding machine according to claim 17, wherein the auxiliary pretreatment mechanism also comprises a fixed clothed segment.

19. A carding method comprising the steps of: feeding a main drum of a carding machine with a first stream of fiber in a thin layer to a first point of interaction with the main drum; feeding the main drum of the carding machine, simultaneously with the first stream, with a second stream of fiber in a thin layer to a second point of interaction with the main drum, the second point of interaction being downstream of the first point of interaction; performing on the fiber carried by the main drum a first parallelization by means of a first set of moving flats having a covering provided with a plurality of teeth having a predetermined population; performing on the fiber carried by the main drum a second parallelization by means of a second set of moving flats situated downstream of the first set of moving flats, the second set of moving flats having a covering provided with a plurality of teeth having a different population than that of the first set of moving flats wherein the first parallelization is less thorough than the second parallelization; and taking the thin layer of parallelized fiber from the main drum by means of a doffer system.

20. The carding method according to claim 19, further comprising the step of cleaning and straightening the first stream of fiber in a thin layer before the stream reaches the second point of interaction.

21. The carding method according to claim 19, further comprising the step of refining the thin layer of fiber, which has already undergone the first parallelization, before it undergoes the second parallelization.

22. The carding method according to claim 21, wherein the refining step comprises the step of cleaning the fiber.

23. The carding method according to claim 22, wherein the refining step comprises the step of straightening the fiber.

* * * * *